US005150962A

United States Patent [19]

Rauschenberger

[11] Patent Number: 5,150,962

[45] Date of Patent: Sep. 29, 1992

[54] TOILET BOWL ILLUMINATING DEVICE

[76] Inventor: Michael Rauschenberger, 1938 Misty Dr., Benton, Ark. 72015

[21] Appl. No.: 833,064

[22] Filed: Feb. 10, 1992

[51] Int. Cl.[5] ..... F21V 33/00

[52] U.S. Cl. ..... 362/101; 362/155; 362/253; 362/802; 4/661

[58] Field of Search ..... 362/101, 155, 253, 802; 4/661

[56] References Cited

U.S. PATENT DOCUMENTS

| | | | |
|---|---|---|---|
| 2,458,019 | 1/1949 | Niles | 362/101 X |
| 2,947,850 | 8/1960 | Reilly | 362/154 |
| 4,413,364 | 11/1983 | Bittaker et al. | 362/802 X |
| 4,860,178 | 8/1989 | Picon | 362/101 |
| 5,003,648 | 4/1991 | Anderson | 4/661 |

*Primary Examiner*—Allen M. Ostrager
*Attorney, Agent, or Firm*—Ray F. Cox, Jr.

[57] ABSTRACT

A toilet bowl illuminating device having a unitary body which can be fastened anywhere about the front or sides of the toilet bowl by clamping to the upper rim of the toilet bowl. A lamp on the end of a segment of the device extends downwardly into the toilet bowl for illumination of the toilet bowl. The device is activated by a momentary, normally closed, push-button switch located on the upper part of the device so that the device is activated by raising the toilet seat.

1 Claim, 2 Drawing Sheets

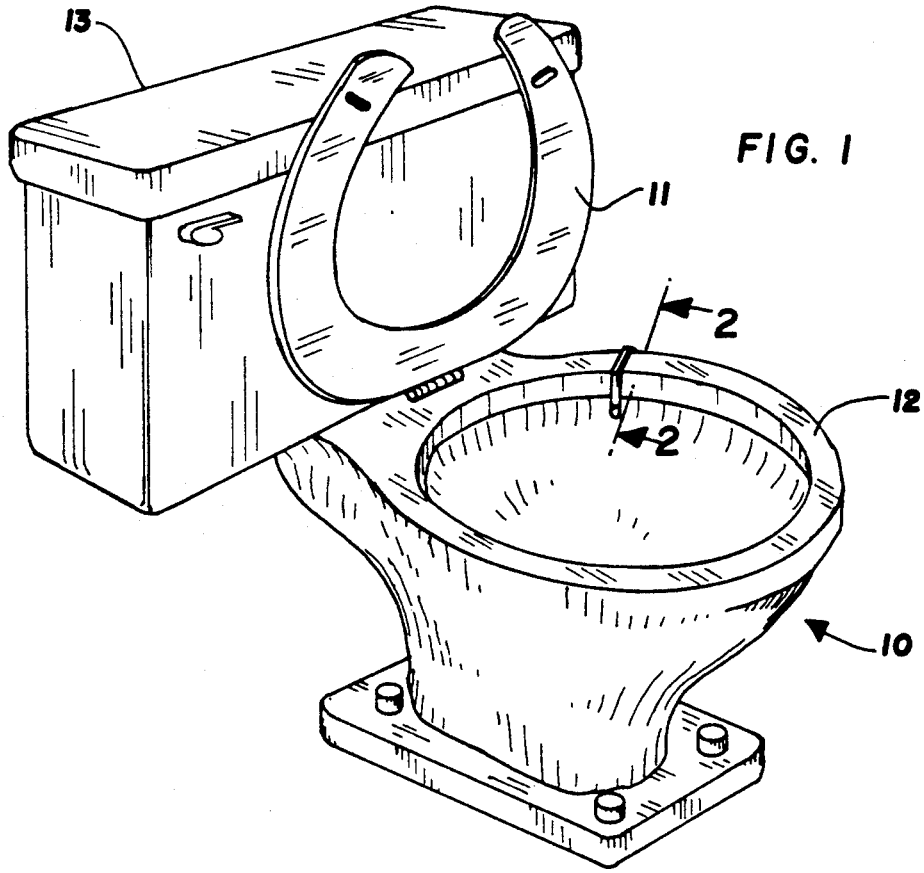
FIG. 1
FIG. 2
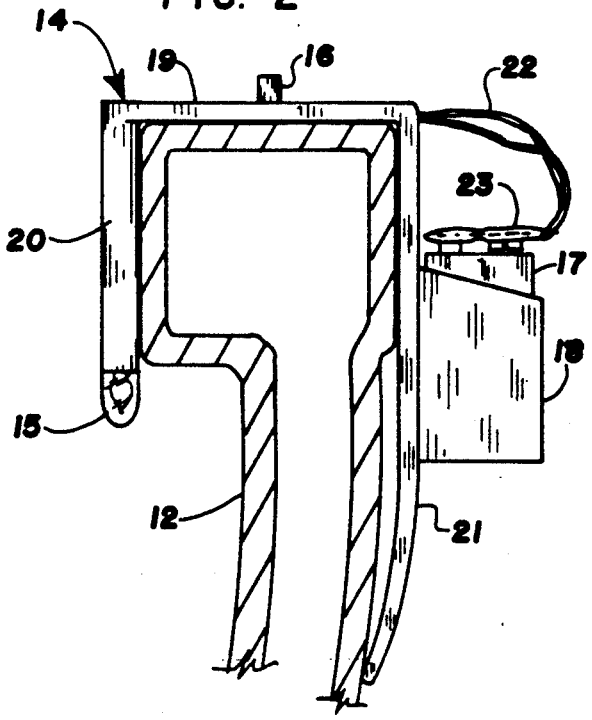

TOILET BOWL ILLUMINATING DEVICE

BACKGROUND OF THE INVENTION

This invention relates to a toilet bowl illuminating device which is adapted to be mounted on the rim of a toilet bowl for illuminating the interior of the toilet bowl when the seat is raised.

Devices for illuminating a toilet bowl are known in the art. For example, Bittaker, et al. U.S. Pat. No. 4,413,364 issued on Nov. 8, 1983 for "Toilet Light Unit" discloses a miniature battery powered lamp mounted on the top rear of a toilet bowl and controlled by a mercury switch on the toilet seat.

SUMMARY OF THE INVENTION

In the preferred embodiment of the present invention, the device has a unitary body which can be fastened anywhere about the front or sides of the toilet bowl by clamping to the upper rim of the toilet bowl. A lamp on the end of a segment of the device extends downwardly into the toilet bowl for illumination of the toilet bowl. The device is activated by a momentary, normally-closed, push-button switch located on the upper part of the device so that the device is activated by raising the toilet seat Likewise, lowering the toilet seat depresses the momentary, normally-closed, push-button switch to turn the device off.

It is a principal object of this invention to provide a toilet bowl illuminating device which may be simply and easily mounted in a variety of locations on a toilet bowl.

It is another object of the present invention to provide for a toilet bowl illuminating device which may be simply and economically manufactured due to its simplified design and reduced number of parts.

It is a further object of the present invention to provide for a toilet bowl illuminating device which is rugged and durable and which may be easily repaired and serviced Further objects and advantages of the present invention will be obvious from the following specification and claims in conjunction with the drawings.

DESCRIPTION OF THE DRAWINGS

FIG. 1 is a perspective view of the present invention installed on the rim of a toilet bowl.

FIG. 2 is a sectional view through the rim of the toilet bowl showing the present invention installed on the rim of the toilet bowl in plan view.

DESCRIPTION OF THE PREFERRED EMBODIMENT

Figure 3:
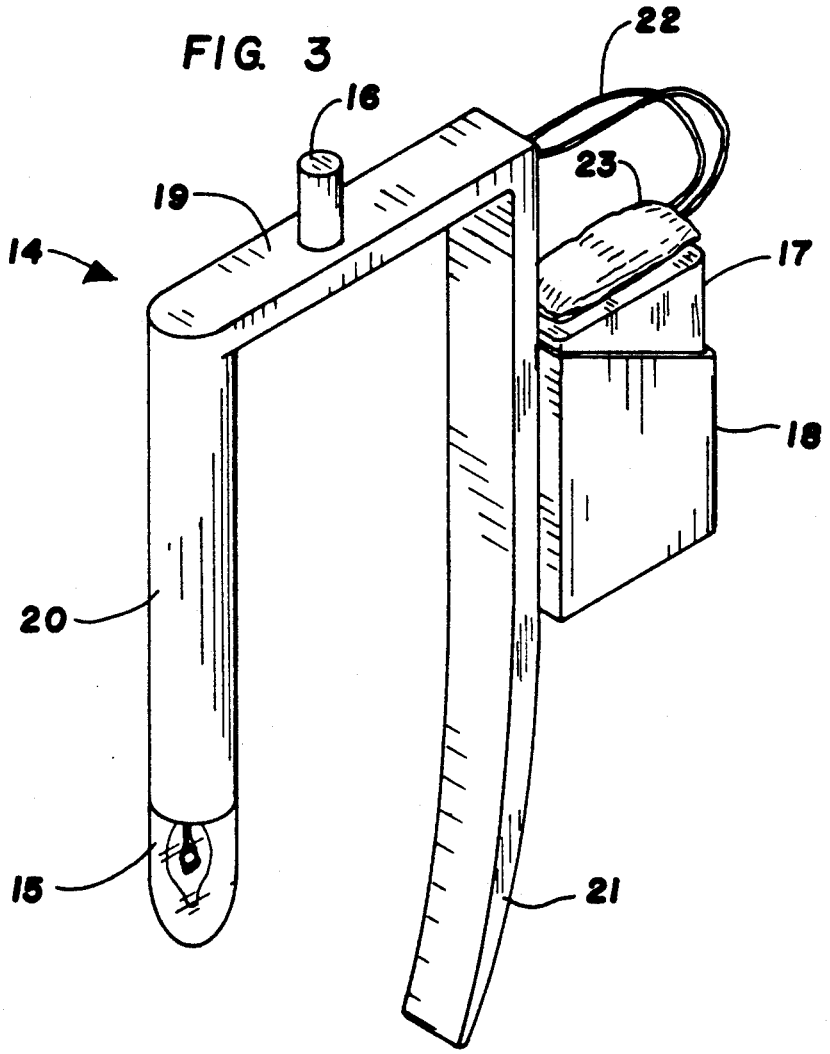
FIG. 3 is a perspective view of the present invention.

Referring to FIG. 1, the present invention is designed to be installed on a toilet of standard configuration having a bowl 10 and a hinged seat 11. The bowl 10 has an upper rim 12. The present invention may be mounted anywhere along the upper rim 12 of the bowl 10 with the exception of the rearward section of the bowl 10 where the rim 12 is generally expanded rearwardly to provide mounting surfaces for the hinged seat 11 and occasionally also for a tank 13.

Referring to FIGS. 2 and 3, the present invention is shown mounted on the upper rim 12 which is shown in partial section and in FIG. 3 in a perspective view. The present invention comprises a body 14, a lamp 15, a momentary, normally-closed, push-button switch 16, a battery 17 and a battery housing 18.

The body 14 is comprised of an essentially flat, horizontal segment 19, an interior segment 20 and an exterior segment 21. The downwardly extending interior segment 20 is attached to the interior end of the horizontal segment 19. The downwardly extending exterior segment 21 is attached to the exterior end of the horizontal segment 19. The overall configuration of the present invention is that of a horseshoe shape in which the interior segment 20 extends downwardly into the toilet bowl so that the lamp 15 mounted on the lower end of the interior segment 20 is positioned within the interior of the toilet bowl 10.

The exterior segment 21 extends both downwardly from the exterior end of the horizontal segment 19 and also inwardly toward the exterior surface of the toilet bowl 10. The body 14 thus fits closely about the upper rim 12 of the toilet bowl 10. The entire body 14 is in the preferred embodiment constructed in a unitary manner of a single piece of flexible plastic material The entire body 14 and, in particular, the exterior segment 21 retains sufficient flexibility so that the body 14 and, in particular, the exterior segment 21 act in a spring-like clamping manner to mount the present invention to the upper rim 12 of the toilet bowl 10. The invention is furthermore releasable from its mounting and easily repositioned at any other point along the upper rim 12.

The lamp 15 is mounted on the lower end of the interior segment 20. The lamp 15 communicates electrically through wires 22 hidden in the body 14 to the push-button switch 16 located on the upper surface of the horizontal segment 19. The push-button switch 16 is also electrically connected to the battery 17. The battery 17 is contained within a battery holder 18 mounted to the exterior of the exterior segment 21. In the preferred embodiment the battery 17 is a standard 9-volt battery and the battery is electrically connected to the push-button switch 16 through wires and a snap-on connector 23 of a type which is well known in the art.

In operation the push-button switch 16 is depressed by the lowering of the seat 11 such that the normally-closed, push-button switch 16 is depressed by the seat 11 and the connection between the battery 17 and the lamp 15 is opened. Raising of the seat 11 allows the push-button switch 16 to assume its normally-closed position, thus establishing electrical connection between the battery 17 and the lamp 15. In other words, raising of the toilet seat 11 causes the lamp 15 to turn on and illuminate the interior of the toilet bowl 10.

The foregoing discussion of the preferred embodiment of the invention is intended to be descriptive and not to limit the scope of the present invention as set forth in the following claims.

What is claimed is:

1. A toilet bowl illuminating device comprising:

a body, comprising an essentially flat horizontal segment having an interior end, an exterior end and an upper surface, an interior segment depending downwardly from said interior end of said horizontal segment such that said interior segment extends into the interior of the toilet bowl when said horizontal segment is positioned on the upper rim of the toilet bowl, and an exterior segment extending downwardly and inwardly from said exterior end of said horizontal segment, said exterior segment further being comprised of a flexible material such that said exterior segment engages the exterior upper rim of the toilet bowl in a releasably clamping manner, said interior segment further having a lower end;

a lamp mounted on said lower end of said interior segment;

a momentary, normally-closed, push-button switch mounted on said upper surface of said horizontal segment and communicating electrically with said lamp;

a battery housing mounted to said exterior segment; and a battery contained within said battery housing and communicating electrically with said push-button switch.

* * * * *